US010614647B2

(12) United States Patent
Deneen et al.

(10) Patent No.: US 10,614,647 B2
(45) **Date of Patent: *Apr. 7, 2020**

(54) REMOTE TRANSMISSION OF BARRIER STATUS AND CHANGE OF STATUS OVER A NETWORK

(71) Applicant: Overhead Door Corporation, Lewisville, TX (US)

(72) Inventors: Tom Deneen, Akron, OH (US); Brent Alan Rauscher, Keller, TX (US); Brent Buescher, Jr., Wooster, OH (US); Mike Dragomier, North Canton, OH (US)

(73) Assignee: Overhead Door Corporation, Lewisville, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/148,913

(22) Filed: Oct. 1, 2018

(65) Prior Publication Data

US 2019/0035193 A1 Jan. 31, 2019

Related U.S. Application Data

(63) Continuation of application No. 14/682,931, filed on Apr. 9, 2015, now Pat. No. 10,096,187.

(51) Int. Cl.

| | |
|---|---|
| ***E05F 1/00*** | (2006.01) |
| ***E05F 15/00*** | (2015.01) |
| ***G07C 9/00*** | (2020.01) |
| ***E05F 15/668*** | (2015.01) |
| ***E05F 15/70*** | (2015.01) |
| ***E05F 15/77*** | (2015.01) |

(52) U.S. Cl.

CPC ..... *G07C 9/00571* (2013.01); *E05F 15/668* (2015.01); *E05F 15/70* (2015.01); *E05F 15/77* (2015.01); *E05Y 2400/66* (2013.01); *E05Y 2400/80* (2013.01); *E05Y 2900/106* (2013.01); *G07C 2009/00928* (2013.01)

(58) Field of Classification Search

CPC ..... E05F 15/00; E05F 1/00; E05Y 2900/106; G07C 2009/00769; G07C 9/00309

See application file for complete search history.

(56) References Cited

U.S. PATENT DOCUMENTS

| | | | |
|---|---|---|---|
| 3,833,895 | A | 9/1974 | Fecteau |
| 4,463,292 | A | 7/1984 | Engelmann |
| 4,821,024 | A | 4/1989 | Bayha |
| 5,148,159 | A | 9/1992 | Clark et al. |

(Continued)

FOREIGN PATENT DOCUMENTS

WO WO-2015073810 A1 * 5/2015 ..... G07C 9/00007

*Primary Examiner* — Ronald D Hartman, Jr.

(74) *Attorney, Agent, or Firm* — Haynes and Boone, LLP

(57) ABSTRACT

An Internet based system for remotely monitoring and changing the open/closed door status of a garage door. A position detector is coupled to the door. Two position detectors, preferably substantially orthogonal with respect to one another, determine the barrier status. A wireless transmitter transmits the barrier status to a multi-functional control module. The control module also receives a change of status command from the Internet Cloud to move one or more doors in accordance with the command. Multiple relays paired with the doors allow the control module to control a plurality of doors.

5 Claims, 8 Drawing Sheets

(56) References Cited

U.S. PATENT DOCUMENTS 5,402,105 A * 3/1995 Doyle ..... G08B 13/08 340/539.14
5,798,681 A 8/1998 Chang
5,872,513 A 2/1999 Fitzgibbon et al.
5,903,226 A 5/1999 Suman et al.
6,011,468 A 1/2000 Lee
6,166,634 A 12/2000 Dean
6,184,787 B1 2/2001 Morris
6,243,000 B1 6/2001 Tsui
6,310,548 B1 10/2001 Stephens, Jr. et al.
6,346,889 B1 2/2002 Moss
6,388,559 B1 5/2002 Cohen
RE37,784 E 7/2002 Fitzgibbon et al.
6,553,238 B1 4/2003 Ginzel et al.
6,597,291 B2 7/2003 Tsui
6,615,132 B1 9/2003 Nagasaka et al.
6,624,605 B1 9/2003 Powder et al.
6,724,316 B2 4/2004 Addy et al.
6,791,467 B1 9/2004 Ben-Ze'ev
6,975,203 B2 12/2005 Brookbank et al.
6,980,117 B1 12/2005 Kirkland et al.
6,989,760 B2 1/2006 Dierking et al.
6,998,977 B2 2/2006 Gregori et al.
7,034,484 B2 4/2006 Gioia et al.
7,071,813 B2 7/2006 Fitzgibbon
7,119,681 B2 10/2006 Eskildsen
7,158,043 B2 1/2007 Kirkland et al.
7,161,319 B2 1/2007 Ergun et al.
7,181,174 B2 2/2007 Fitzgibbon et al.
7,224,275 B2 5/2007 Fitzgibbon
7,266,344 B2 9/2007 Rodriguez
7,342,368 B2 3/2008 Roman
7,468,676 B2 12/2008 Styers et al.
7,482,923 B2 1/2009 Fitzgibbon
7,498,936 B2 3/2009 Maeng
7,515,063 B2 4/2009 Brundula
7,532,709 B2 5/2009 Styers et al.
RE41,452 E 7/2010 Wojciak, Jr.
7,750,890 B2 7/2010 Fitzgibbon et al.
7,778,604 B2 8/2010 Bauman et al.
7,852,212 B2 12/2010 Fitzgibbon
7,876,218 B2 1/2011 Fitzgibbon
8,144,011 B2 3/2012 Fitzgibbon
8,207,818 B2 6/2012 Keller, Jr.
8,279,040 B2 10/2012 Laird
8,345,010 B2 1/2013 Fitzgibbon et al.
8,421,591 B2 4/2013 Karasek
8,587,404 B2 11/2013 Laird
8,643,465 B2 2/2014 Fitzgibbon
RE44,816 E 3/2014 Gioia et al.
8,866,583 B2 10/2014 Ordaz
2002/0180600 A1 12/2002 Kirkland et al.
2002/0183008 A1 12/2002 Menard et al.
2003/0076235 A1 4/2003 Tsui
2004/0212498 A1 10/2004 Peterson et al.
2010/0171588 A1* 7/2010 Chutorash ..... G07C 9/00182 340/5.71
2010/0297941 A1 11/2010 Doan et al.
2011/0311052 A1 12/2011 Myers et al.
2013/0328663 A1* 12/2013 Ordaz ..... G05B 19/042 340/5.62
2014/0266593 A1* 9/2014 Nye ..... G07C 9/00126 340/5.71
2014/0320263 A1* 10/2014 Fan ..... E05F 15/77 340/5.71
2015/0077219 A1* 3/2015 Keller, Jr. ..... E05F 15/40 340/5.7
2015/0148983 A1* 5/2015 Fitzgibbon ..... G05B 19/41855 700/302
2016/0258202 A1* 9/2016 Scalisi ..... G07C 9/00309
2017/0034485 A1* 2/2017 Scalisi ..... H04N 7/186
2017/0175433 A1* 6/2017 Kang ..... E05F 15/77
2017/0236354 A1* 8/2017 Baker ..... H04L 12/28 340/5.71
2017/0294113 A1* 10/2017 McNabb ..... G08C 17/02
2018/0151006 A1* 5/2018 Huggins ..... H04W 4/80
2018/0216389 A1* 8/2018 Tsui ..... E05F 15/40
2018/0245395 A1* 8/2018 Huggins ..... E05F 15/77
2018/0247475 A1* 8/2018 Archbold ..... G07C 9/00309
2018/0357847 A1* 12/2018 Shinar ..... G07C 9/00309

* cited by examiner

REMOTE TRANSMISSION OF BARRIER STATUS AND CHANGE OF STATUS OVER A NETWORK

PRIORITY CLAIM

Pursuant to 35 U.S.C. § 120, this application is a continuation of, and incorporates by reference for all purposes, U.S. patent application Ser. No. 14/682,931, entitled "Automatic Transmission of a Barrier Status and Change of Status Over a Network," filed Apr. 9, 2015, now U.S. Pat. No. 10,096,187, and naming Tom Deneen, Brent Alan Rauscher, Brent Buescher, and Mike Dragomier as inventors.

TECHNICAL FIELD

The present disclosure relates to the field of remote monitoring and controlling, over a network, the status of a movable barrier, and more particularly to the field of remote monitoring and instructing changes to, over the Internet, the open or closed status of a movable garage door.

BACKGROUND

Movable barriers, such as upward acting sectional or single panel garage doors, residential and commercial rollup doors, and slidable and swingable gates, are used to alternatively allow and restrict entry to building structures and property. These barriers are driven between their respective open and closed positions by coupled barrier moving units, sometimes referred to as "barrier operators", and in the specific case of a door, as "door operators," and in the even more specific case of a garage door, as "garage door operators."

For example, a typical garage door operator for driving an upward acting sectional garage door between its open and closed positions includes, as a central control unit, a microcontroller for (i) processing incoming user-actuated door instructions and (ii) generating output control signals corresponding to these instructions; a motor controller for receiving and transmitting these control signals to a motor; and a DC or AC motor drivingly coupled to the garage door. The user-actuated door instructions are in the form of wired or wireless signals transmitted to the microcontroller from interior or exterior wall consoles or from proximately located hand held or vehicle mounted RF transmitters.

With the near ubiquity of the Internet and the proliferation of electronic devices and equipment designed to access the Internet, such as personal computers, cellphones, and Smartphones, systems are currently being designed and implemented in the trade that enable non-proximate, or remote, monitoring and control, via the Internet, of a variety of home appliances, building doors, and the like. For example, if a homeowner is not in proximity to its residence, and needs to determine whether the garage door it had intended to close, did in fact close, or whether the garage door it needed to leave open for a workman to enter had, in fact, been left open, using one of these systems, he/she can, through access over the Internet, remotely monitor the status of the garage door (e.g., whether it is open or closed). Moreover, if the garage door is not in the desired position, these systems are designed to also enable the homeowner to transmit change of door status commands over the Internet to effect the desired position, all without having to be physically proximate the garage to do so.

For example, U.S. Pat. No. 6,998,977 ("the '977 patent"), issued to The Chamberlain Group, Inc., generally describes one type of such system. According to that description, the garage door status (open, closed, opening, closing, or at a mid-point location) is sent over a network interface to the network (i.e., the Internet) in response to request(s) for such status. While the disclosed system does provide for remote monitoring of the garage door status, it suffers from a variety of drawbacks. For example, because the status of the door is sent only in response to a request for such status, the system must necessarily account for two-way communication over the network interface and the network—first, the status request, and then, the status—which necessarily introduces an undesirable lag in time necessitated by this back and forth propagation. Moreover, this required two-way communication (and consequent display) will necessarily require increased bandwidth, and bandwidth (particularly cellular data bandwidth) can be expensive in today's world.

In addition, neither of the network interfaces described in the '977 patent is adequate for optimum performance nor do they effectively address the complexities involved with the monitoring and control of door status in multiple door arrangements. Thus, there is a need for a new and improved communication system that enables a user, by way of a network such as the Internet, to more effectively remotely monitor and control the status of movable barriers, specifically one that avoids the inefficiency of status requests, incorporates new and improved means for enabling independent change, from a single source, of the door status of any one of multiple doors, and otherwise incorporates features that meet the convenience, response time, and communication demands of today's fast paced society.

SUMMARY

In accordance with the aforementioned and other objectives, disclosed herein is a new and improved Internet-based door monitoring and control communication system that enables the detection of door status by a position detector physically attached to each monitored door, which door status is thereafter transmitted to a multi-functional control module adapted to wirelessly transmit the door status information, via a designated building ("home") router, to the Internet Cloud, for storage and final transmission to Internet access equipment, such as a mobile wireless communication device, like a "smart" cellphone (i.e., a "Smartphone"). The Smartphone then enables the user to access the Internet and view the transmitted door status information.

The multi-functional control module is also adapted to enable the actuation of one or more operatively connected door operator(s) respectively controlling the movement of the monitored door(s), in accordance with change of door status commands, these commands either user-initiated from the Smartphone and/or automatically generated from the Cloud, and wirelessly transmitted back through the Internet Cloud, and home router, to the multi-functional control module.

In accordance with an important aspect of this communication system, all door status information is "pushed" all the way from the position detector to the Smartphone, without any request for such door status, thus avoiding unnecessary communication lag and excessive use of bandwidth associated with status requests.

In accordance with a preferred embodiment of the system, the door is a residential garage door, each position detector sensing the fully closed or not fully closed (i.e. open) door status, this door status information then wirelessly transmitted to the control module, using Bluetooth, and the control module thereafter wirelessly transmitting, using Wi-Fi, the door status information to the Smartphone. Also transmitted is coding sufficient to enable the Smartphone to direct change of door status commands to the desired door operator associated with the monitored door for which change of status is desired.

In a preferred embodiment of the system, the door status information is automatically transmitted in response to a change of orientation of the garage door between fully closed or open (i.e., event driven) or, in the absence of such change, in accordance with a pre-established periodic pulse rate.

The herein described communication system is configured to monitor and control the door status of a single door or a plurality of doors. To effect change of door status, and in accordance with a preferred embodiment of the system, the door control module is adapted to pair selective monitored doors with selective normally-open relays adapted to be temporarily closed by the remotely generated change of door status commands. This coded pairing is wirelessly transmitted, via the Internet Cloud, to the Smartphone which, under the direction of its stored application, enables the user to transmit back to the door control module, via the Internet Cloud, these change of door status commands. This results in the relevant connected relay(s) momentarily closing, resulting in the corresponding door opener(s) directing the movement (e.g., the opening or closing) of its associated door(s) in accordance with the respective change of door status command(s).

These, and other, features of this new and improved communication system, as well as the advantages thereof, will become readily apparent from the following detailed description, read in conjunction with the accompanying drawings, in which:

DETAILED DESCRIPTION

One or more embodiments of communication systems in accordance with the principles of the present invention will be described below. These described embodiments are only examples of techniques to implement the invention, as defined solely by the attached claims. Additionally, in an effort to provide a focused description of the invention and the principles of the invention, irrelevant features of an actual implementation may not be described in the specification.

Figure 1:
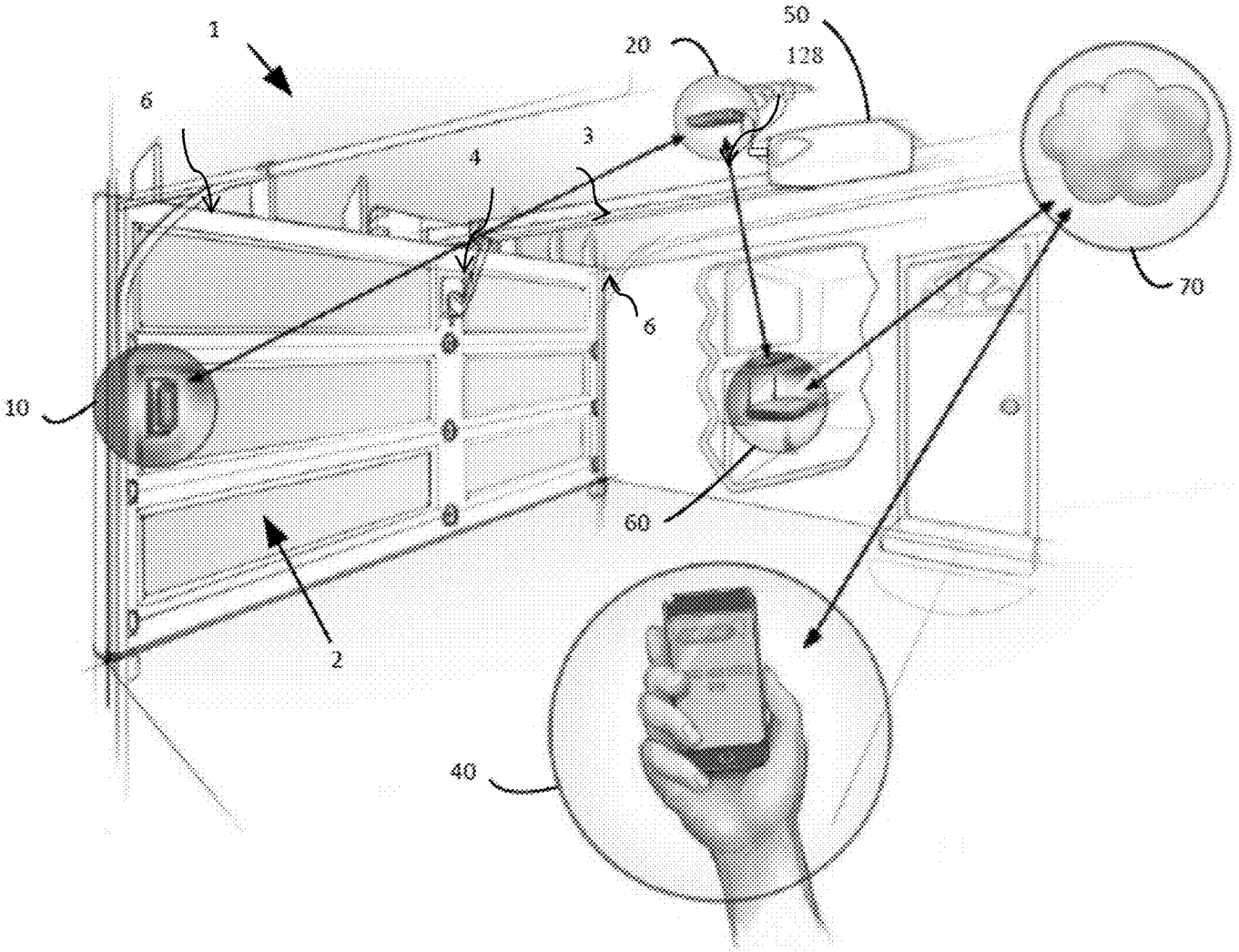
FIG. 1 is a diagrammatical illustration of a preferred embodiment of an Internet based communication system in accordance with the principles of the present invention for remotely monitoring and changing the status of a residential garage door.

With initial reference to FIG. 1, there is depicted a basic embodiment of an Internet based communication system 1 for monitoring the open/closed status, as well as remotely changing the status, of an upward acting sectional residential garage door 2. The system 1 includes a barrier mover (specifically, a garage door operator) 50 of any conventional design and operation that serves to move the garage door 2 between its open position and closed position (latter shown in FIG. 1.) For example, it may be the head type shown in FIG. 1, like those manufactured and sold by GMI Holdings Corp., d/b/a The Genie Company, of Mt. Hope, Ohio, and/or similar to that described in U.S. Pat. No. 6,118,243, issued Sep. 12, 2000 to Reed et. al., the contents of which are hereby incorporated by reference in their entirety for all purposes to the maximum extent allowable under the law. Accordingly, the door operator 50 includes a microcontroller for, inter alia, processing received door movement commands to generate motor control signals, corresponding to such commands, provided to a DC or AC motor (not shown.) The motor is operatively coupled to a drive assembly (not shown) reciprocatingly driving a carriage along a rail assembly 3, the carriage connected by arm 4 to the door 2, resulting in the door 2 being driven by the motor along parallel tracks 6 between its open and closed positions. Alternatively, if desired, any drive assembly may be used with door operator 50 to open and close the door 2 in accordance with the incoming commands, including various types of jackshaft drive assemblies well known to those in the industry.

In accordance with the embodiment of the system 1 depicted in FIG. 1, a position detector 10 is physically attached to the interior of garage door 2, preferably at the top sectional panel, for monitoring the open/close status of the garage door (i.e. whether the garage door is in the open position or the closed position). The position detector 10 is in bidirectional wireless communication with a multi-functional control module 20. The control module 20 is, itself, in bidirectional wireless communication with a conventional router 60 located at the designated home or business facility, which router is in bidirectional wireless communication with one or more servers located in Internet Cloud 70. A server 62 (shown in FIG. 2) of the Internet Cloud 70 designated to provide the functions of the system 1 is in bidirectional wireless communication with the Smartphone 40.

Accordingly, the garage door status monitored by position detector 10 is wirelessly transmitted, preferably using Bluetooth, to control module 20. Control module 20 then automatically wirelessly transmits this monitored door status information, preferably using Wi-Fi, to the Internet Cloud 70, via router 60, for initial storage in one of the designated servers of the Internet Cloud 70. This server then subsequently wirelessly transmits the door status information to the Smartphone 40 for viewing by the user.

The transmission of the door status information from the position detector 10 to the control module 20 occurs whenever there is a change of door status, as well as in accordance with a pre-established periodic pulse at a transmission pulse rate unique to the detector 10, typically every 30 seconds. Similarly, door status information received by the control module 20 (as well as codes defining the router I.D. and the paired relationship between the detector 10 and the control module 20) are transmitted from the control module 20 for storage in the designated server in the Internet Cloud 70 whenever the control module 20 detects a change of door status, as well as in accordance with a pre-established periodic pulse at a transmission pulse rate unique to the control module 20, typically every 20 minutes. The transmitted door status stored in the designated Internet Cloud server is then subsequently transmitted to the Smartphone 40. In no event is there ever a request for door status information made or received by any component of the system 1, the door status information instead always being "pushed" from component to component.

If the door status is desired to be changed, the Smartphone 40 wirelessly transmits the change of status command (e.g., close an open door, or open a closed door) in the reverse direction, to the router 60, via the Internet Cloud 70, and thereafter to the control module 20 which, in accordance with the subsequently described procedure, activates the door operator 50 to toggle its associated door in accordance with the transmitted change of status command.

To provide for carrying out of the change of door status instruction, a normally-open relay 128 is operatively associated with control module 20, door operator 50 being conductively connected with such relay. Thus, assuming the position detector 10 has been paired with the relay 128, any change of door status command (e.g., open a closed door, or close an open door) reaching the control module 20 results in the momentary closure of relay 128, thereby actuating the door operator 50 to carry out the command, for example by either opening the garage door, if closed, or closing the garage door, if open.

The Internet based system 1 may be used to remotely monitor and change the status of a single barrier or one or more barriers of a multiple barrier arrangement. Accordingly, and with reference now to FIG. 2, there is described the system 1 for the exemplary monitoring and control of the status of three garage doors, to which position detectors 10*a*, 10*b*, and 10*c* are respectively attached. Barrier movers, constituting garage door operators 50*a*, 50*b*, and 50*c*, are adapted to move their respectively associated garage doors between their open and closed positions. Each of the position detectors 10*a*, 10*b*, and 10*c* is in bidirectional wireless communication with multi-functional control module 20. Garage door operators 50*a*, 50*b* and 50*c* are in wired conductive connection with control module 20 through respective normally-open door control relays 128*a*, 128*b*, and 128*c*.

The control module 20 is in bidirectional wireless communication, via the router 60, with the Internet Cloud 70, typically comprising a plurality of interconnected servers, with Internet server 62 dedicated to the operation of system 1. Accordingly, coded information from control module 20 (comprising, at least (i) the identification of the paired relationship between the monitored doors (or their attached position detectors) and the respective door control relays, (ii) the door status of each monitored door, and (iii) the router I.D.) is wirelessly transmitted, via router 60, to Internet Cloud 70 and temporarily stored in server 62. Thereafter, such information is wirelessly routed, without request, by server 62 to Smartphone 40. If the status of one or more of the monitored doors is to be changed, the Smartphone wirelessly directs such change of status command, via the Internet Cloud, back to the control module 20 for actuation of the relay(s) that had been identified to the Smartphone as paired with the door(s) to which the door command pertains. For example, if the door to which position detector 10*b* shows to be open is desired to be closed, and such door has been paired with relay 128*b*, the instruction signal from Smartphone 40 to close that door will be routed to relay 128*b*, temporarily closing that relay, and resulting in the actuation of door operator 50*b* to close its associated door. Additional and more specific details of this overall operation will be subsequently described after now first describing the detailed design and operation of principal components of system 1 carrying out such operation.

Figure 3:
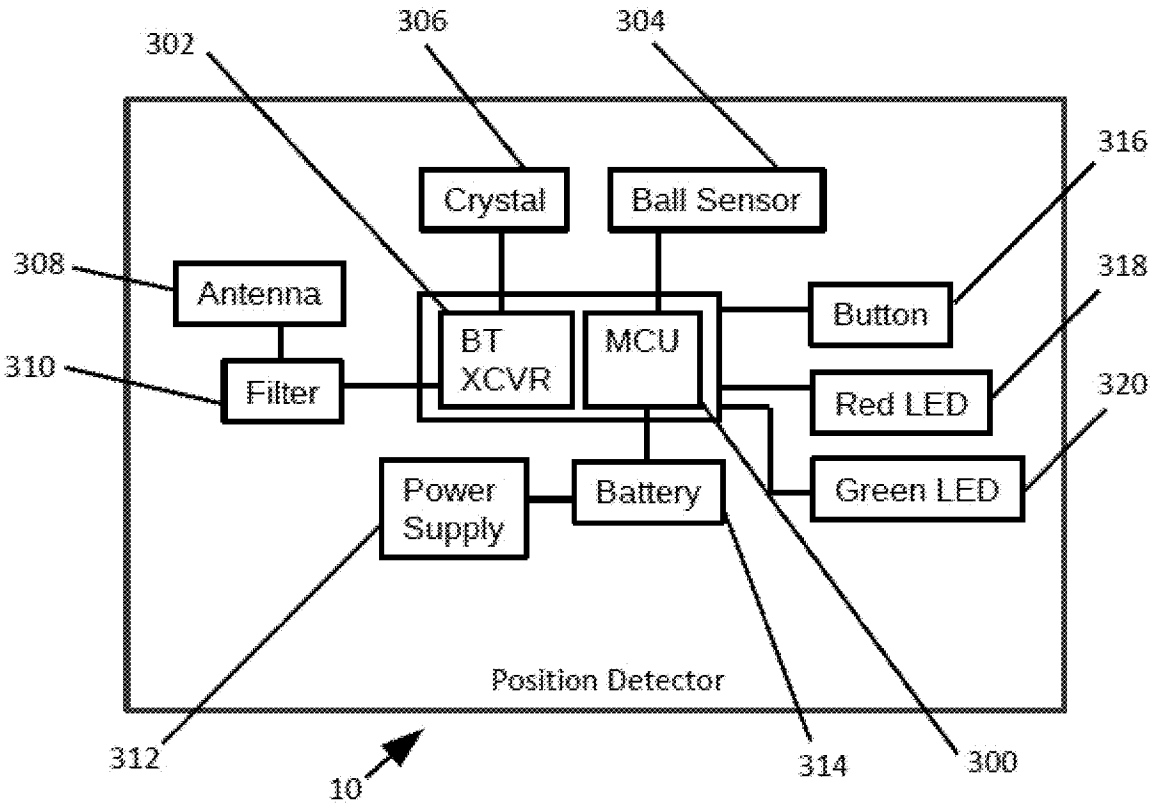
FIG. 3 is a schematic block diagram of a preferred embodiment of a position detector of the Internet-based communication system illustrated in FIG. 2.

Accordingly, with reference now to FIG. 3, there is initially described a preferred embodiment of the position detectors 10*a*, 10*b*, and 10*c*. Thus, each position detector, the design and operation of which is preferably identical to one another, comprises a pair of conductive ball tilt switch sensors 304 and 305, preferably mounted to the top panel of the interior of the garage door. Each sensor is placed substantially orthogonal to one another, and adapted for movement by gravity to either short or open circuit a pair of contacts associated with each sensor, depending upon the angular orientation of the sensor, and therefore the angular orientation of the door to which they are attached. For example, when the top panel of the garage door is within a specified angle of horizontal (e.g., 30 degrees), a first pair of contacts associated with switch sensor 304 will be shorted, and a second set of contacts associated with switch sensor 305 will be open circuited, therefore indicating the door to be substantially "open". Similarly, when the door panel is within a specified angle of vertical (e.g., 30 degrees), the second set of contacts associated with sensor 305 will be shorted and the first set of contacts associated with sensor 304 are open circuited, therefore indicating the door to be substantially "closed." This arrangement therefore not only enables signals to be generated indicating the "open" or "closed" orientation of the garage door, but also avoids a false signal being generated as a consequence of only one switch being toggled between open and closed positions due, for example, to vibrations caused, inter alia, by wind blowing against the garage door. Moreover, this dual sensor arrangement reduces the overall current consumption, thereby extending battery life, that otherwise would be incurred with a single sensor.

While various types of tilt switch assemblies will be useful for the afore described purpose, a preferred form of such switches may be obtained from OncQue Corporation of Taichung, Taiwan and/or described in U.S. Pat. Nos. 6,518,523 and 7,256,360, the entire contents of which are hereby incorporated by reference to the maximum extent allowable under the law.

Each of the three position detectors 10 also preferably includes a crystal 306 controlled transceiver 302 for enabling bidirectional wireless communications with the control module 20, preferably using Bluetooth, for the initial door/relay pairing and door status transmission operations subsequently described. An antenna 308 is coupled to the transceiver 302 through filter 310 for transmission and reception of wireless signals to and from control module 20. An embedded microcontroller 300 monitors the sensor inputs from ball sensors 304 and 305 and effects control over the transceiver 302. Momentary button switch 316 sets up the position detector for initial pairing and activates the LEDs 318 and 320 in a pattern that indicates to the user the Bluetooth link, battery and setup status. The microcontroller is powered by battery 314.

Figure 4:
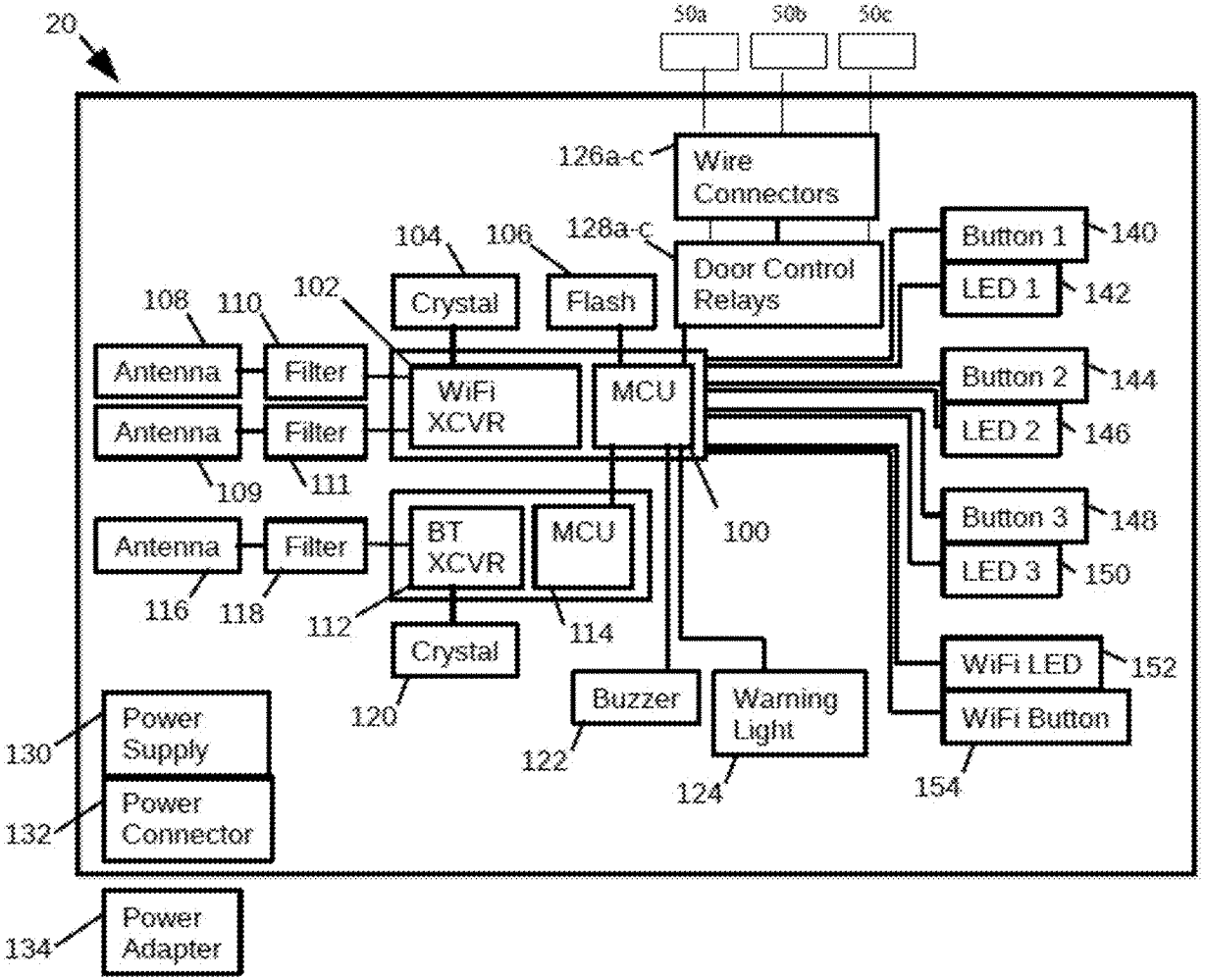
FIG. 4 is a schematic block diagram of a preferred embodiment of the multi-functional control module of the Internet-based communication system illustrated in FIG. 2.
Figure 5:
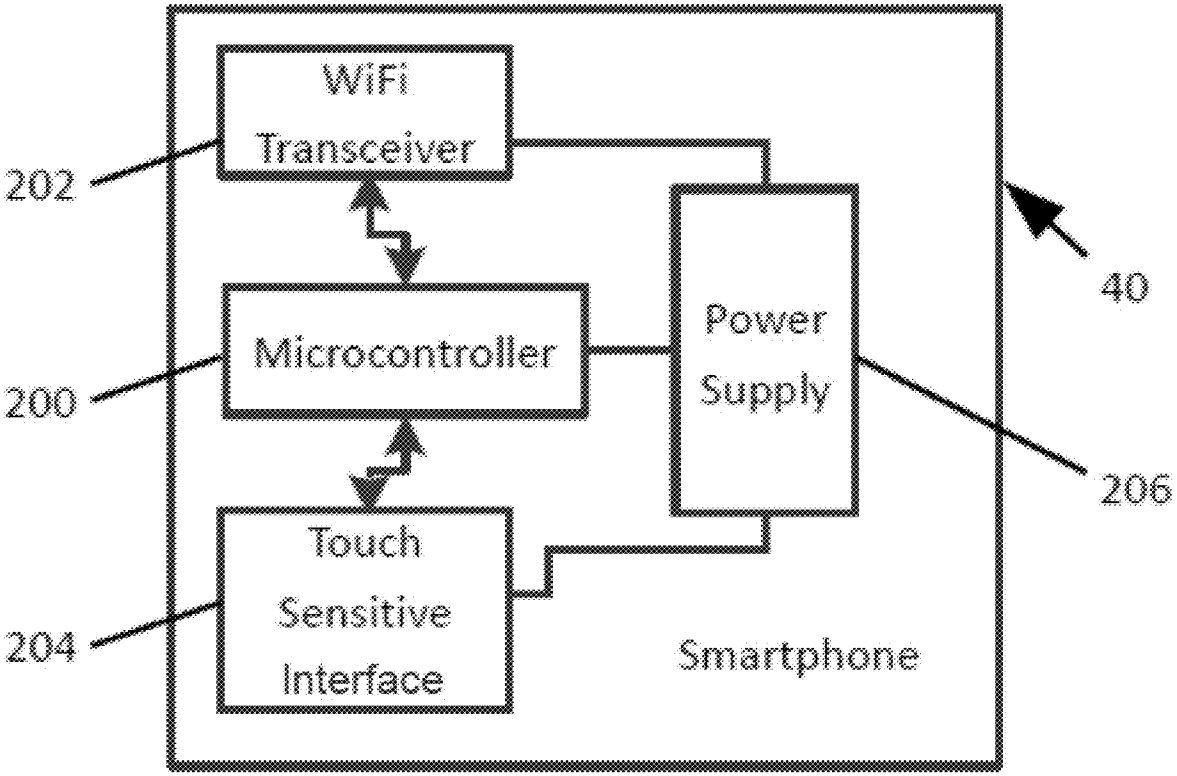
FIG. 5 is a schematic block diagram of a preferred embodiment of a Smartphone of the Internet-based communication system illustrated in FIG. 2.

Referring now to FIG. 4, a preferred embodiment of the control module 20 is described. The control module 20 comprises a crystal 120 controlled transceiver 112 for enabling bidirectional wireless communications with all three position detectors 10*a*, 10*b*, and 10*c*. As such, its wireless technology protocol needs to match that of the position detectors, which is preferably Bluetooth. An antenna 116 is coupled to the transceiver 112 through filter 118 for transmission and reception of wireless communications to and from the three position detectors, and an embedded microcontroller 114 effects control over the transceiver 112, as well as coordinating the transmission of door status messages to and from the control module 20 through its interconnection with embedded microcontroller 100.

A crystal 104 controlled WiFi transceiver 102 enables Wi-Fi wireless communications with the Internet Cloud 70 via router 60, and associated embedded microcontroller 100 effects control over the transceiver 102 as well as over door control relays 128*a*, 128*b*, and 128*c* for the pairing operations subsequently described. Antennas 108 and 109 are respectively coupled through filters 110 and 111 to transceiver 102 for transmission and receipt of the incoming and outgoing Wi-Fi signals, the details of which are subsequently described. Flash memory 106 is coupled to the microcontroller 100 for data storage purposes.

Normally-open door control relays 128*a*, 128*b*, and 128*c* are respectively connected to garage door operators 50*a*, 50*b*, and 50*c* by way of wire connectors 126*a*, 126*b*, and 126*c*, so that the closing of any of these relays results in the activation of its respectively coupled door operator to toggle its associated garage door from one status to the other (e.g., from the closed to the open position, from the open to the closed position, or to a mid-point position.) Operation of the particular door control relay(s) is under the control of embedded microcontroller 100, which in turn is dependent on the coding in the incoming Wi-Fi signal from the Internet Cloud 70. Depression of buttons 140, 144 and/or 148 enable an initial pairing of the three door control relays 128*a*-128*c* with the respective position detector 10*a*-10*c*, and therefore with the respective garage doors. LEDs 142, 146 and 150 provide user feedback regarding status.

Depression of a Wi-Fi button 154 establishes a WiFi connection between the control module 20 and the router 60, and Wi-Fi LED 152 confirms such connection. A hardwired power supply 130 provides mains power for the control module 20 received through the power connector 132 from the power adapter 134. A buzzer 122 and warning light 124 provide warning that the garage door will be imminently moved and/or is in motion.

The control module can be mounted on the inside wall of the garage at a level conveniently accessed by the homeowner. When so mounted, it can be placed in parallel with the conventional push button wall console or, if desired, the push button control can be added to the control module 20, thus enabling the assembly to serve both the function of a user-actuated attended door opener, as well as the herein described remote door monitoring and unattended door control.

Referring now to FIGS. 5 and 6A-6C, specific details of the typical design of a Smartphone 40 with the application of system 1 will now be described. The Smartphone 40 typically includes a touch sensitive interface 204, serving both display and user input functions. In addition, the Smartphone includes an operating system comprising a Wi-Fi transceiver 202 and cellular transceiver 203 for transmitting and receiving wireless communications with the Internet Cloud 70, and a microcontroller 200 with stored program for providing the necessary operation. A battery 206 provides power to these components.

Figure 6A:
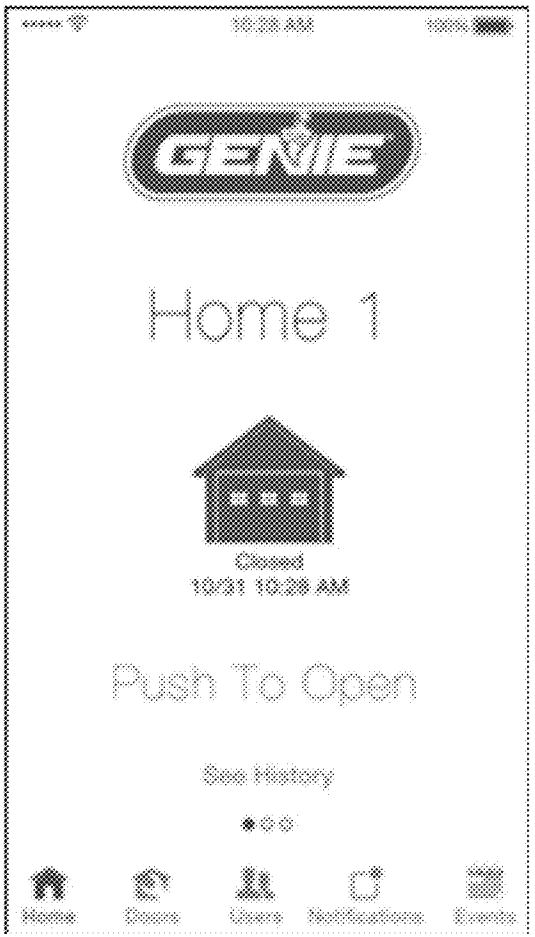
FIG. 6A is an example of a user interface of a Smartphone displaying the door status of a monitored door in the Internet-based communication system illustrated in FIG. 2.
Figure 6B:
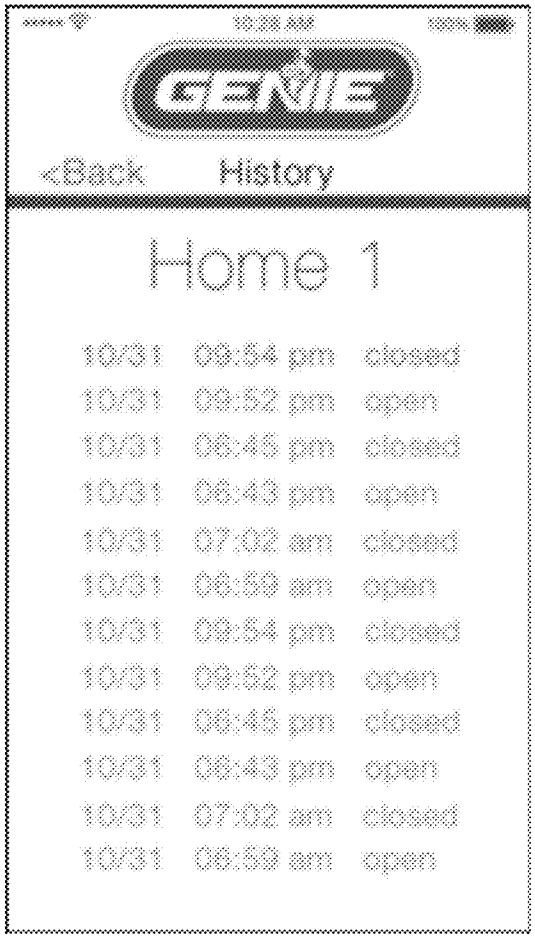
FIG. 6B is an example of a user interface of a Smartphone screen for displaying previously received door status information in the Internet-based communication system illustrated in FIG. 2.
Figure 6C:
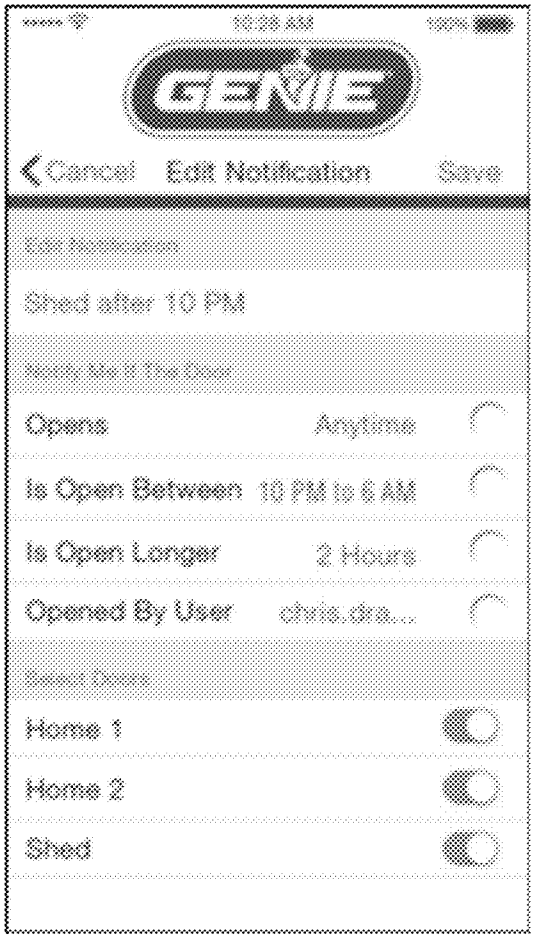
FIG. 6C is an example of a user interface of a Smartphone for presenting options for remote control of one or more doors in the Internet based communication system illustrated in FIG. 2.

An example of the display on the interface 204 showing the "closed" door status of one of the doors at home that was last received by the Smartphone 70, and presenting the user with the option to issue a command to "open" the door is depicted in FIG. 6A. An example of the display on the interface 204 summarizing the open/closed status of the same door during the day is depicted in FIG. 6B. An example of the display on the interface 204 showing the different door status, and command options, for two home doors and a shed is depicted in FIG. 6C.

Figure 2:
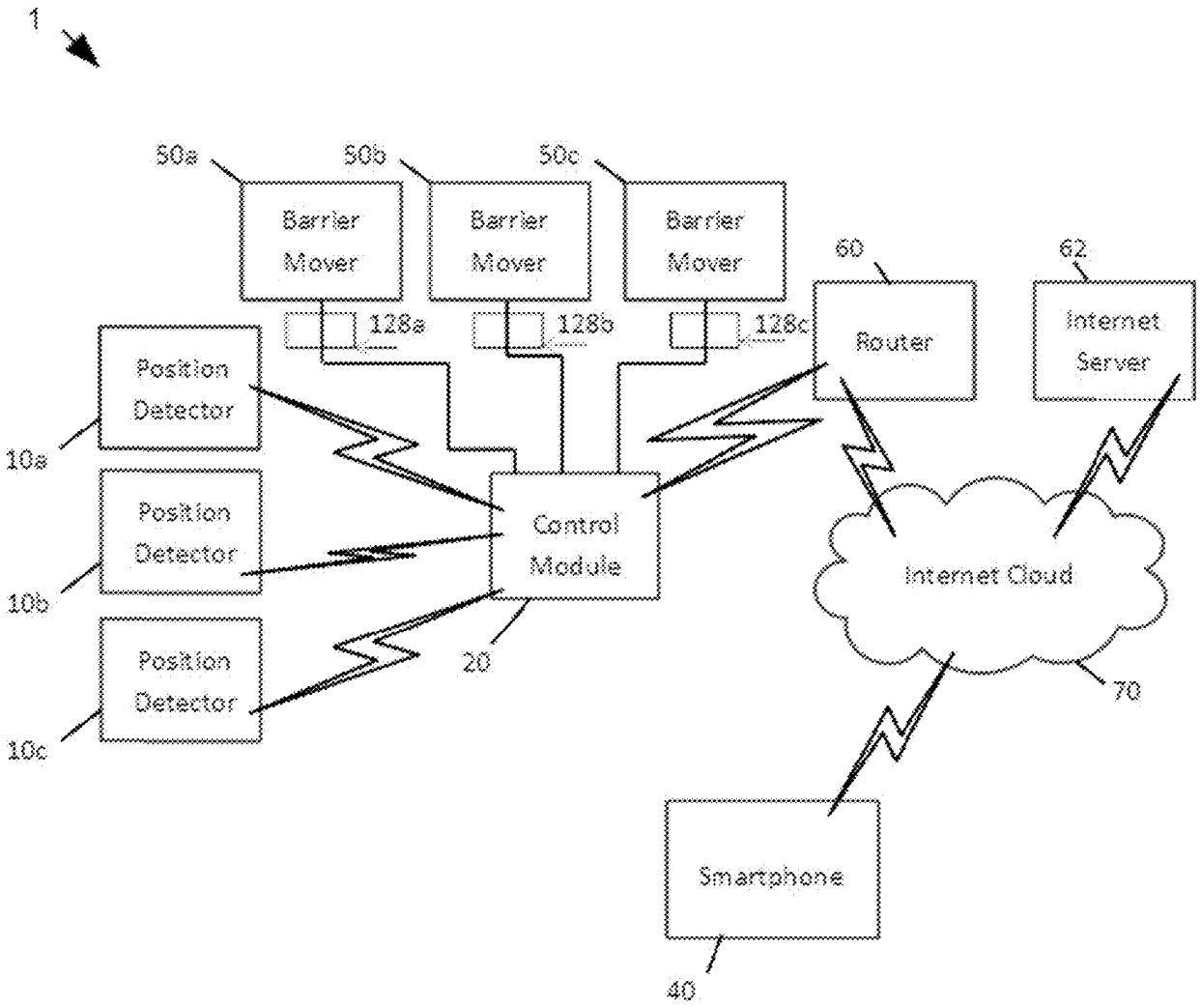
FIG. 2 is a schematic block diagram of a preferred embodiment of the interconnection of the principal components of the Internet based communication system illustrated in FIG. 1 for the remote monitoring and control of one or more residential garage doors.

The overall operation of the Internet-based remote communication system 1 of FIG. 2 is now described in detail. The initial step is to determine which of the door control relays 128*a*-128*c* (and therefore, which of the door operators 50*a*-50*c*) are to be paired with which of the monitored doors. This is accomplished by the depression of the button 316 on the respective position detector 10*a*, 10*b*, and/or 10*c* that is desired to be "active" and the depression of the corresponding button 1 (140), button 2 (144), and/or button 3 (148) on the control module 20 representing the "active" door(s).

The "active" position detectors thereafter transmit their respective on/off door status to the control module 20, and the control module 20 thereafter wirelessly transmits to the Internet Cloud 70, using Wi-Fi, the coded (i) door status of each "active" door, (ii) the pairing of the relay(s) with the active door(s), and (iii) the router 60 I.D. This information is stored in Internet server 62. A signal containing (i) the door status of the active doors, (ii) the aforestated pairing arrangements, and (iii) a router I.D. is thereafter transmitted to the Smartphone 40.

If the status of one or more selective doors is to be changed, the Smartphone 40 thereafter transmits to the control module 20, via Internet Cloud 70 and router 60, coded (i) change of status commands for the selected door(s), (ii) the pairing arrangement of the so selected door(s) and their associated relay(s), and (iii) router 60 I.D., thereby enabling the microcontroller 100 to activating the relay(s) paired with the selected door(s), and causing the connected garage door operator(s) to be actuated to change the door status of the associated door(s).

This change of door status should be detected by the relevant position detector, transmitting the change of door status to the control module 20 and thereafter, the Smartphone 40, as previously described. However, if the control module 20 fails to receive this change of door status information within a predetermined time period, the microprocessor 100 of the control module 20 pushes an error signal to the Smartphone 40 over the Internet 70. For example, if the instruction received from the Smartphone 40 is to close the garage door, but because of an obstruction in the door path, the door does not close and instead returns to its open position, the microprocessor 100 of the control module 20 will transmit an error signal to the Smartphone 40, indicating such failure.

In some applications, the Smartphone may be used to transmit for storage in the barrier server 62, a specific time of day that the garage door is to always be closed, the maximum time a door is to remain open before closing, and/or the time that the door is to be opened and then closed to allow temporary access to the garage. Under such circumstances, when the designated time is reached, the change of door status will be automatically transmitted to the control module from the Internet Cloud 70 to carry out the particular instruction(s).

The microcontroller 300 of a position detector 10*a*, 10*b*, 10*c* may monitor the battery 314 of that position detector, and at regular intervals, transmit a low battery status signal to the control module 20. The control module 20, upon receipt, transmits the battery status to the Smartphone 40 over the Internet 70, ultimately with the aim of allowing the user to know when the battery 314 of that position detector 10*a*, 10*b*, 10*c* is in need of changing.

While the aforementioned design and operation have been described with respect to a limited number of embodiments, those skilled in the art, having benefit of this disclosure, will appreciate that other embodiments can be envisioned that do not depart from the scope of the disclosure as disclosed herein. Accordingly, the scope of the disclosure shall be limited only by the attached claims.

For example, while the above system 1 has been described as remotely monitoring and controlling the status of residential garage doors, it may similarly be used to monitor and control the status of any movable barrier, regardless of whether the barrier opens vertically or horizontally, or whether it be a sectional or one piece door. In addition, while the above system 1 has been described as monitoring and controlling the open and closed status of a door, it can also monitor and control the status of a door at any position. Furthermore, in addition to, or instead of, the network being the Internet, any network may apply, such as an intranet, wide area network, or local area network. Also, in some cases, the position detector 10 need not be of a tilt switch type physically attached to the door, but may be of any other type sufficiently proximate thereto to effectively monitor its orientation.

Figure 7:
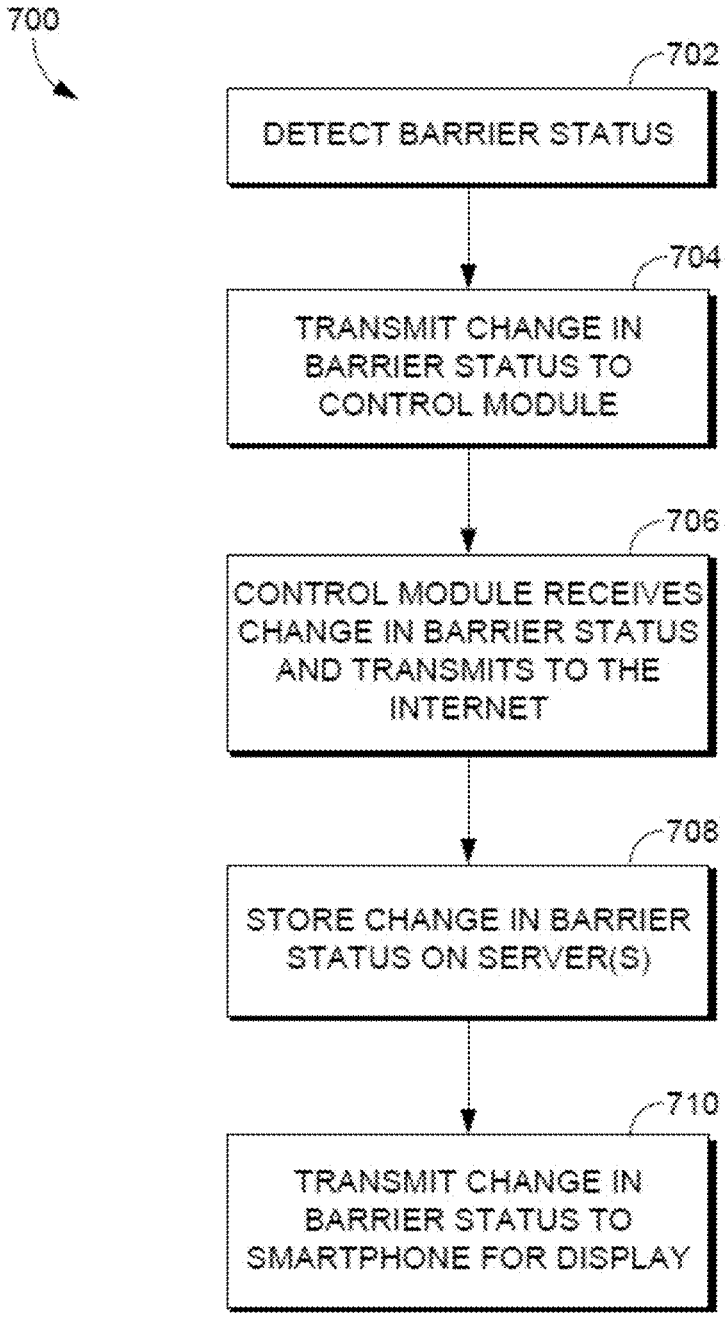
FIG. 7 illustrates a computer flow chart diagram of a work flow for remotely monitoring a barrier for changes in status and enabling an Internet-connected device, namely a Smartphone, to display the detected barrier changes.

FIG. 7 illustrates a work flow 700 for remotely monitoring a barrier for changes in status and notifying an Internet-connected device, such as Smartphone 40, of detected barrier changes. Initially, as indicated at block 702, a position detector 10 uses internal tilt switches to detect the status of a barrier (i.e., whether the associated barrier is in the open or closed position). When the status of the barrier changes, the position detector 10 wirelessly transmits, preferably using Bluetooth, the change in status of the barrier to the control module 20, as indicated at block 704. This wireless transmission of the change in status of the barrier occurs without request of the control module 20. In other words, it is pushed and not pulled. Embodiments may transmit the change in barrier status immediately upon detection by the position detector 10 or may wait to transmit the change in barrier status according to a pre-established periodic pulse rate.

As shown at block 706, the control module 20 receives and wirelessly transmits, preferably via Wi-Fi, the change in status of the barrier detected by the position detector 10 to a router 60, which in turn transmits the status change through a network, such as the Internet Cloud 70. Like the position detector 10, the control module 20 pushes the status change of the barrier without being requested. The change in barrier status is communicated through the network and stored on one or more servers 62, as indicated at block 708. The servers 62 communicate the change in status of the barrier to the Smartphone 40, as indicated at block 710, and the Smartphone 40 displays the status of the barrier to a user.

Moreover, multiple position detectors 10*a-c* may be in wireless communication with a single control module 20, and each position detector 10*a-c* may push barrier-status information for their respective barriers to the control module 20. The control module 20 can wirelessly transmit the status of multiple barriers through the network to the server 62, which can provide the status information of the multiple barriers to the Smartphone 40 of the user. Thus, embodiments may monitor one or more barriers with a single control module 20.

Figure 8:
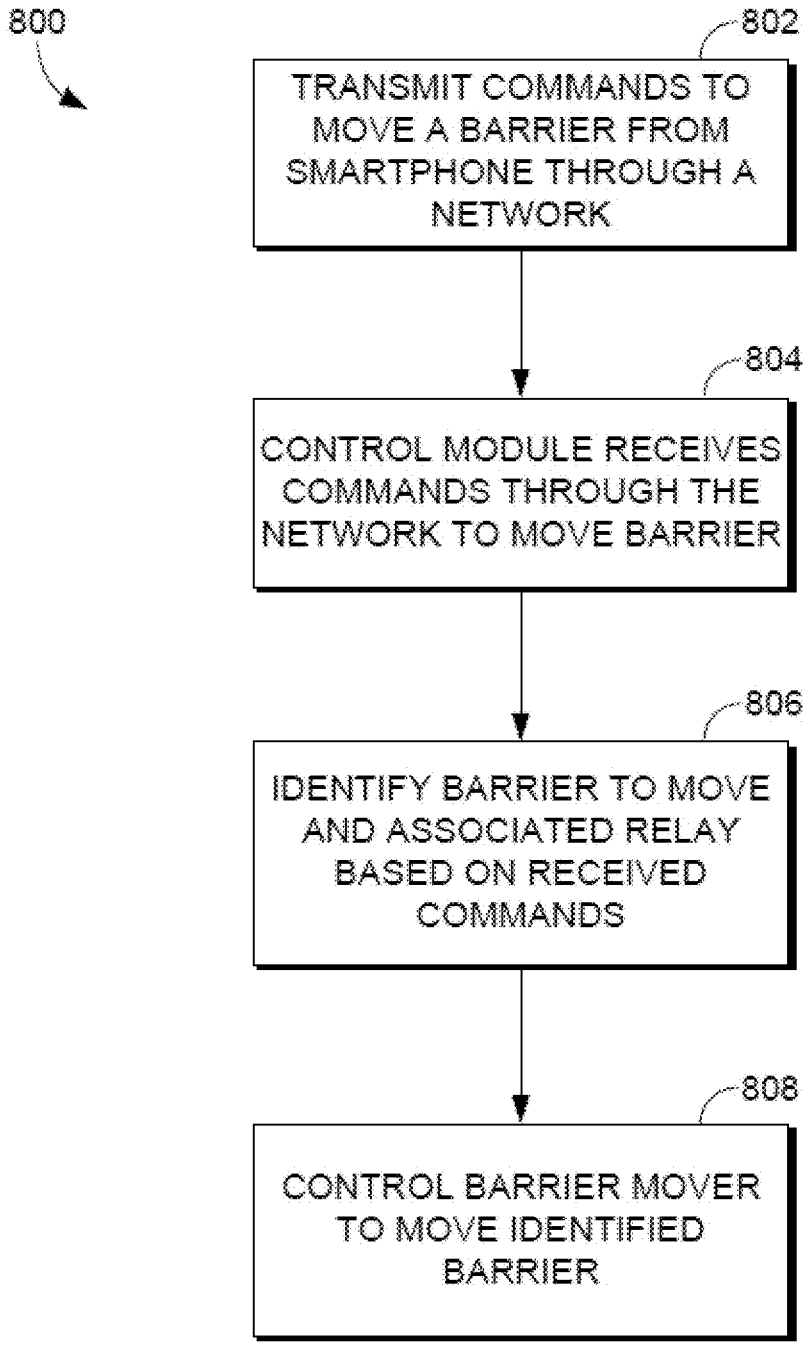
FIG. 8 illustrates a computer flow chart diagram of a work flow for transmitting a change of barrier status command from a Smartphone to cause an identified barrier mover to move the identified barrier.

FIG. 8 illustrates a work flow 800 for controlling one or more barriers via an Internet-connected device. Initially, as indicated at block 802, commands to move a barrier (e.g., open door, close door, etc.) are transmitted from the Smartphone 40 through a network, such as the Internet Cloud 70, to the router 60. The movement commands include: (i) coded change-of-status command for selected barrier(s), and (ii) pairing information for specific relays of the selected barrier(s). The router 60 wirelessly communicates the movement commands to the control module 20, as indicated at block 804. The control module 20 uses the pairing information to identify which barrier to move and the relay 128 paired with the identified barrier, as indicated at block 806. The control module 20 executes the change-of-status command by opening or closing the paired relay and thereby causing a respective barrier mover 50 to move the barrier between open and closed positions.

In collective reference to FIGS. 7-8, work flows 700 and 800 are provided merely for explanatory purposes and should not be construed to necessarily limit all embodiments to a particular sequence of operations. Alternative embodiments may perform some or all of the depicted steps out of the illustrated sequences of depicted work flows 700 and 800, or in parallel with other steps.

We claim:

1. An Internet based communication system for remotely monitoring, as well as remotely changing, via the Internet, the open or closed door status of respective ones of a plurality of garage doors, the garage doors adapted to be respectively moved between their open and closed positions by, when actuated, associated door operators, the communication system comprising:

sensors configured to monitor the respective positions of selective ones of said garage doors;

a control module in communication with said sensors for wirelessly transmitting the respective open or closed door status of the garage doors;

each of the door operators respectively connected to the control module by way of relays, the actuation of the relay associated with its door operator enabling actuation of that door operator;

the control module configured to (a) enable pairing of the relays with respective ones of the sensors, and thus pairing with the garage doors to which the sensors are respectively monitoring and (b) wirelessly transmit, via a router and the Internet, to an Internet server, first coded information representing (i) the open or closed door status of respective garage doors, (ii) the pairing of the relays with the respective garage doors, and (iii) an identification of said router;

the Internet server configured to store said first coded information for subsequent transmission to a Smartphone; and the control module additionally configured to receive second coded information transmitted by the Smartphone representing (i) a change of door status command for each garage door selected by a user of the Smartphone, (ii) the pairing of the relay with the so-selected garage door, and (iii) the identification of said router, whereby the relay paired with the selected garage door is actuated, thereby enabling the actuation of the associated door operator in compliance with the change of door status command.

2. The communication system of claim 1 wherein the sensors push the door status to the router at a regular time interval.

3. The communication system of claim 2 wherein the regular time interval is twenty minutes.

4. The communication system of claim 1 wherein the sensors push the door status to the router upon a change in door status.

5. The communication system of claim 1 wherein the relays are in wire connection with respective door operators.

* * * * *